US006598841B2

(12) United States Patent
Erickson et al.

(10) Patent No.: US 6,598,841 B2
(45) Date of Patent: Jul. 29, 2003

(54) HEIGHT ADJUSTABLE TABLE LEG

(75) Inventors: Jason D. Erickson, Durant, IA (US); Craig H. Schultz, Muscatine, IA (US); Michael J. Bell, Davenport, IA (US)

(73) Assignee: Hon Technology Inc., Muscatine, IA (US)

( * ) Notice: Subject to any disclaimer, the term of this patent is extended or adjusted under 35 U.S.C. 154(b) by 0 days.

(21) Appl. No.: 09/862,768

(22) Filed: May 21, 2001

(65) Prior Publication Data

US 2002/0014564 A1 Feb. 7, 2002

Related U.S. Application Data

(60) Provisional application No. 60/209,938, filed on Jun. 7, 2000.

(51) Int. Cl.[7] ..... F16M 11/26; F16B 7/10

(52) U.S. Cl. ..... 248/188.5; 248/188.2; 248/292.12; 248/407; 403/109.5

(58) Field of Search ..... 248/188.5, 188.8, 248/188.2, 410, 407, 159, 292.12, 125.8, 421; 403/104, 109.1, 109.2, 109.5, 109.7, 109.8

(56) References Cited

U.S. PATENT DOCUMENTS

| | | | | | |
|---|---|---|---|---|---|
| 499,671 | A | * | 6/1893 | Gard et al. | 248/188.5 |
| 513,058 | A | * | 1/1894 | Rahmer | 248/155 |
| 880,063 | A | * | 2/1908 | Beilfuss | 248/188.5 |
| 1,768,427 | A | * | 6/1930 | Stevens | 248/411 |
| 2,016,132 | A | * | 10/1935 | Bergslien | 248/409 |
| 2,113,282 | A | * | 4/1938 | Quinn | 182/205 |
| 2,262,939 | A | * | 11/1941 | Howard | 248/188.5 |
| 3,064,934 | A | * | 11/1962 | Desmarais | 248/409 |
| 3,589,757 | A | * | 6/1971 | Mooney | 248/188.5 |
| 3,704,850 | A | * | 12/1972 | Hendrickson et al. | 248/188.5 |
| 3,833,127 | A | * | 9/1974 | Schoen et al. | 211/86 |
| 3,854,428 | A | * | 12/1974 | Fullenkamp | 108/136 |
| 3,882,966 | A | * | 5/1975 | Fasano | 182/205 |
| 4,155,527 | A | * | 5/1979 | Sjoberg | 173/185 |
| 4,185,936 | A | * | 1/1980 | Takahashi | 16/DIG. 39 |
| 4,362,415 | A | * | 12/1982 | Metz et al. | 248/285.1 |
| 4,451,084 | A | * | 5/1984 | Seeley | 248/297.31 |
| 4,596,484 | A | * | 6/1986 | Nakatani | 248/188.5 |
| 4,761,092 | A | * | 8/1988 | Nakatani | 248/188.5 |
| 5,513,825 | A | * | 5/1996 | Gutgsell | 108/147 |
| 6,032,914 | A | * | 3/2000 | Bastida | 248/188.5 |
| 2002/0125381 | A1 | * | 9/2002 | Yoon | 248/163.1 |

FOREIGN PATENT DOCUMENTS

| | | | | |
|---|---|---|---|---|
| DE | 3841254 | A1 * | 6/1990 | A47B/9/20 |

* cited by examiner

*Primary Examiner*—Leslie A. Braun
*Assistant Examiner*—Naschica S. Morrison
(74) *Attorney, Agent, or Firm*—Jones Day

(57) ABSTRACT

The present invention provides a height adjustable table leg including an upper housing attachable to an underside of a table and being formed with an upper tubular portion. A lower tube member is dimensioned and configured to be telescopingly received by the upper tubular portion. A cam member is pivotably mounted to the upper tubular portion and selectively cooperates with an undulating strip attached to the lower tube member in one of a plurality of telescoped positions relative to the upper tubular portion.

7 Claims, 4 Drawing Sheets

HEIGHT ADJUSTABLE TABLE LEG

CROSS-REFERENCE TO RELATED APPLICATIONS

Priority is claimed from Provisional Application Ser. No. 60/209,938, filed Jun. 7, 2000.

BACKGROUND OF THE INVENTION

1. Field of the Invention

The present invention relates generally to the construction of a table leg and, more particularly, to a table leg that is conveniently manually adjustable in height to permit an associated table top to be positionable at any one of a range of heights.

2. Description of the Related Art

Tables are used in a wide variety of applications to support various objects or serve as work or other activity surfaces, for example. It is sometimes desirable to provide a table with height adjustable legs such that the table top can be raised or lowered to a particular desired height. Such a table can thereby be adjusted, for example, to match the height of an adjacent table top or other surface. It is also sometimes desirable to provide height adjustable tables which can be stored underneath one another to free up surrounding space when the tables are not in use.

A typical form of a height adjustable table is one, for example, having telescoping legs. However, as heretofore known such legs are usually adjusted by means of removing and replacing nuts and bolts in various positions of holes provided in the legs. Such an operation is by its nature time consuming and usually involves the use of tools.

Accordingly, it is desirable to provide a height adjustable leg for a table which can be conveniently adjusted through a range of heights without the need for tools. It is further desirable to provide such a table leg which employs a mechanism that positively locks the leg at the desired height and contributes to a stable table assembly. Still further it is desirable to provide a height adjustable table leg assembly which is cost effective to produce in manufacture.

SUMMARY OF THE INVENTION

The present invention improves over the prior art by providing a height adjustable table leg including an upper housing attachable to an underside of a table and being formed with an upper tubular portion. A lower tube member is dimensioned and configured to be telescopingly received by the upper tubular portion. A cam member is pivotably mounted to the upper tubular portion and selectively cooperates with an undulating strip attached to the lower tube member in one of a plurality of telescoped positions relative to the upper tubular portion.

BRIEF DESCRIPTION OF THE DRAWINGS

The foregoing and other novel features and advantages of the invention will be understood upon a reading of the following detailed description taken in conjunction with the accompanying drawings wherein.

DETAILED DESCRIPTION OF THE PREFERRED EMBODIMENT

Figure 1:
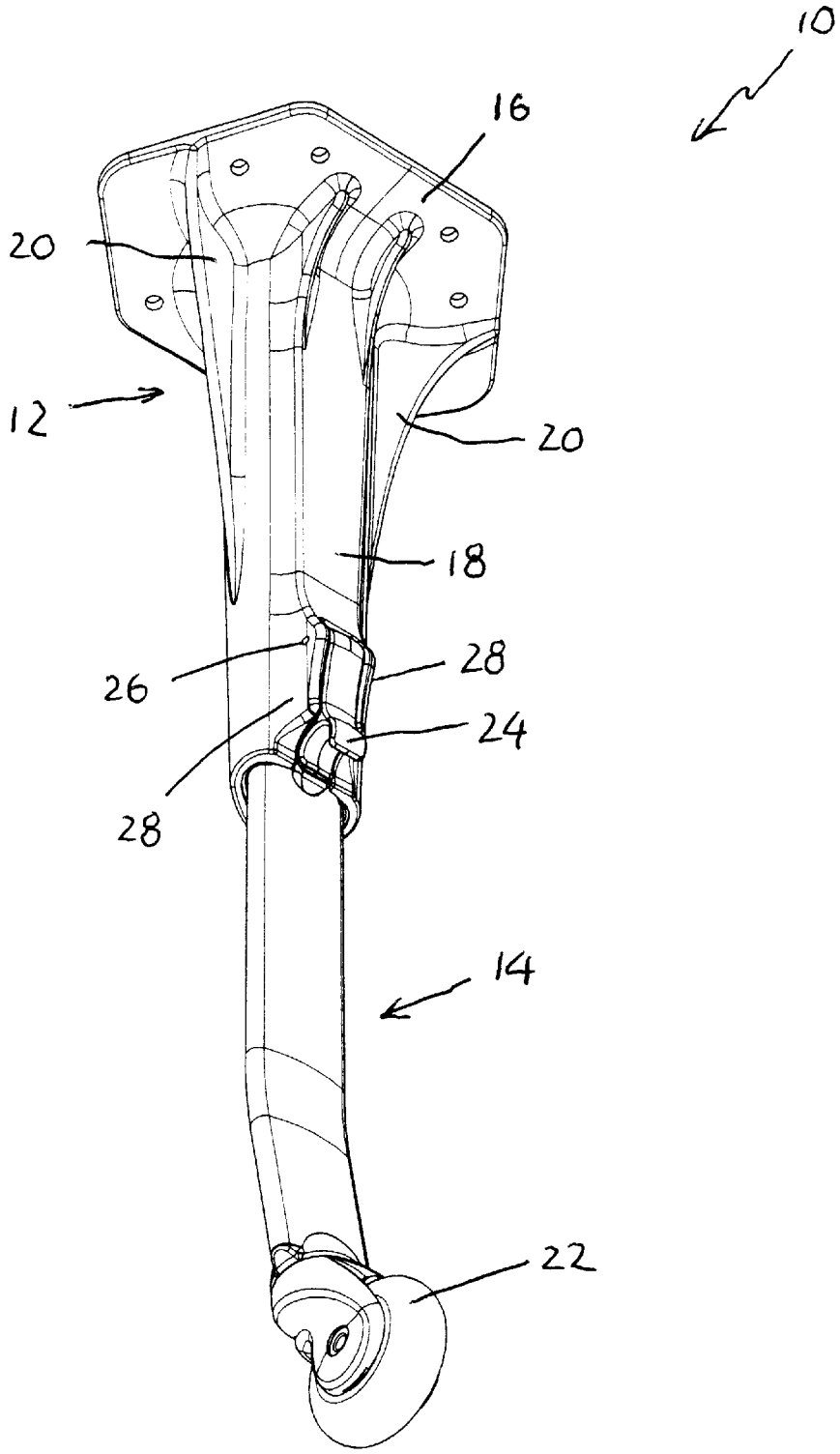
FIG. 1 is a right rear perspective view of a table leg constructed in accordance with the principles of the invention.
Figure 2:
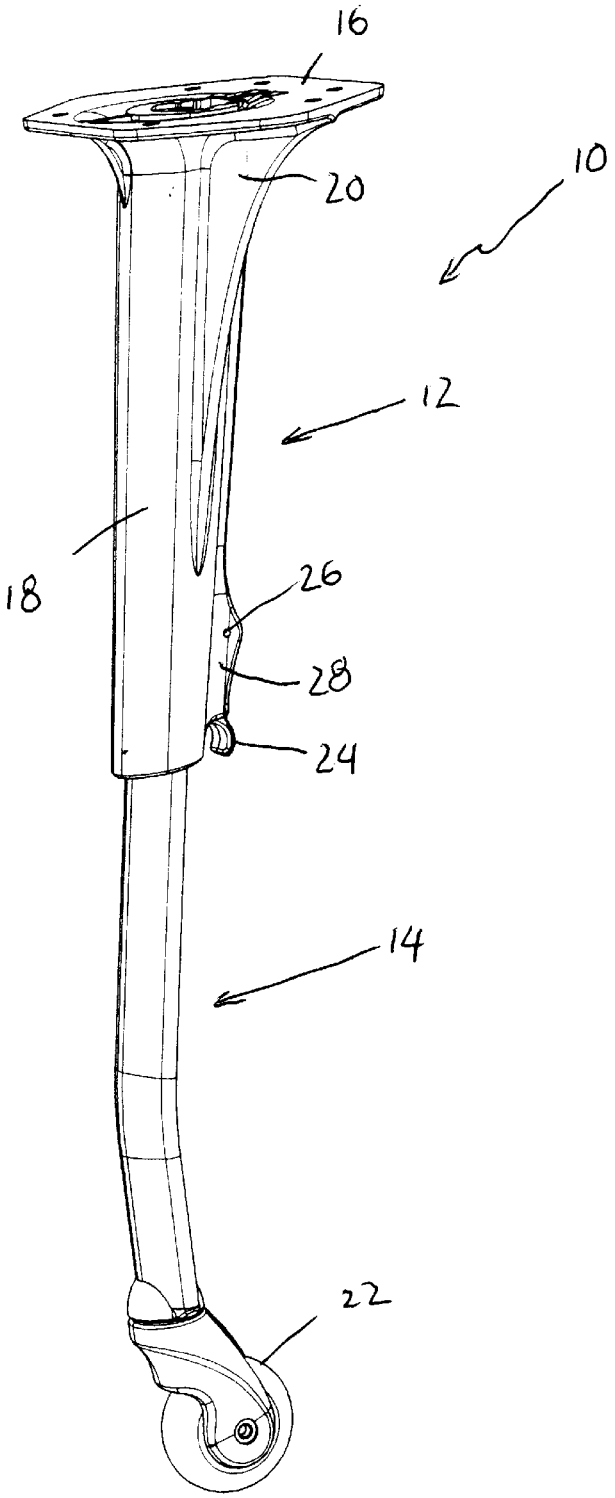
FIG. 2 is a right front perspective view of the table leg.
Figure 3:
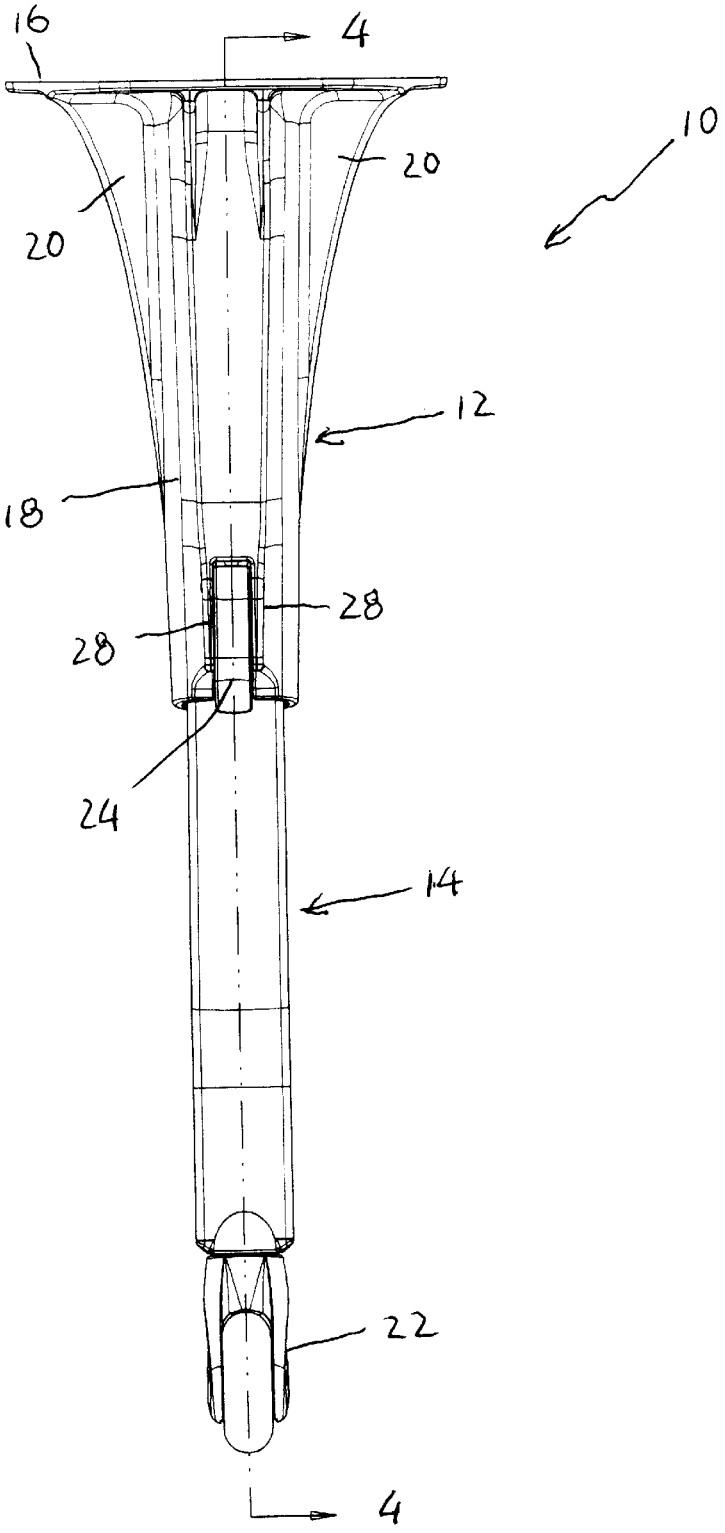
FIG. 3 is a rear elevational view of the table leg.

Referring now to the drawings, and initially to FIGS. 1–3, a table leg constructed according to the invention is designated generally by the reference numeral 10 and includes as its principal components an upper housing 12 and a tube member 14. The upper housing 12 is preferably formed from cast metal as an integral structure including a generally hexagonal mounting plate 16 from which a tubular section 18 extends. The tubular section 18 and tube member 14 are generally triangular in cross-section such that the tube member 14 can be telescopingly received by the tubular section 18 but is restricted from relative rotation therein. Suitable gussets 20 may be provided to strengthen the housing 12. A caster 22 may be provided if desired on the bottom end of the tube member 14. As best seen in FIG. 1 a pivotable adjustment handle 24 is mounted by a pin 26 to a pair of spaced flanges 28 projecting from the tubular section 18 of the housing 12.

Figure 4A:
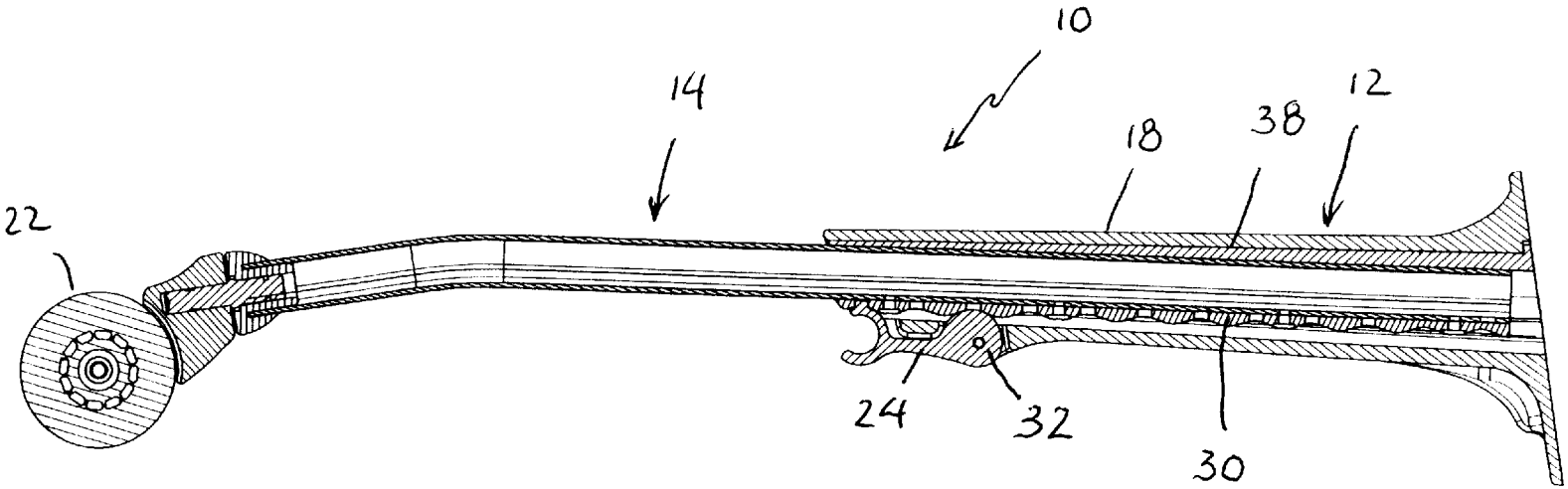
FIG. 4*a* is a cross-sectional view taken along the line 4—4 of FIG. 3 showing the adjustment lever in an engaged position.
Figure 4B:
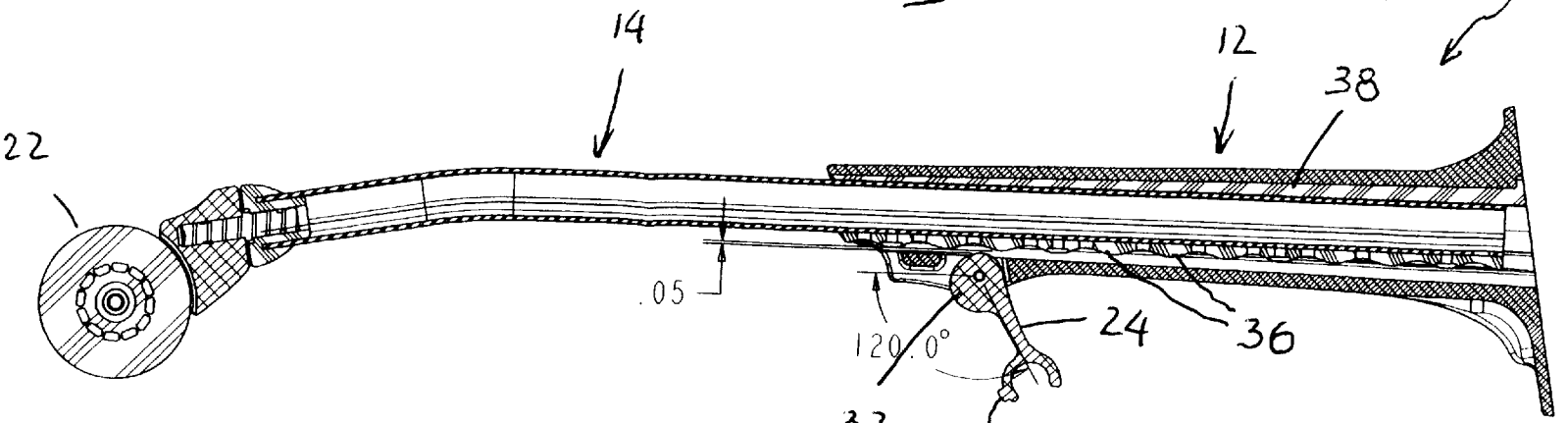
FIG. 4*b* is a cross-sectional view taken along the line 4—4 of FIG. 3 showing the adjustment lever in a disengaged position.

Turning now to FIGS. 4*a* and 4*b,* the tube member 14 can be seen to include an undulating strip 30 attached to a rear side of the tube member 14. The strip 30 may be formed from plastic and configured to have peaks and valleys alternating in height from ¼ inch to ⅛ inch every inch of its length. The handle 24 has a cam portion 32 which as best seen in FIG. 4*a* cooperates with the strip 30 to frictionally lock the tube member 14 at any one of several positions relative to the housing 12. To further lock the tube member 14, and as best seen in FIG. 4*b,* the distal end of the handle 24 may also be provided with a projection 34 which is received by one of a series of apertures 36 in the strip 30. The housing 12 may be provided with a plastic insert 38 fitted into the tubular section 18 to avoid metal-to-metal contact of the tube member 14 and section 18.

It can now be appreciated that a table leg 10 constructed according to the invention offers considerable advantages where it is desired to have a conveniently manually adjustable height table. In a preferred form of the invention, the strip may be approximately 12 inches long with undulations every one inch thereof. Thus, a leg according to a preferred form of the invention can be adjusted in one-inch increments from 27 inches long to 34 inches long. Thus, the leg is suitable to provide a table top that can be used in both a sit-down and stand-up mode. Further, selected legs may be conveniently adjusted to provide a slanted work surface if desired. The construction of the present locking mechanism is such that a positive, reliable system for locking is also achieved.

While the present invention has been described in connection with preferred embodiments, it will be apparent to those skilled in the art that many changes and modifications may be made without departing from the true spirit and scope of the invention. Accordingly, it is intended by the appended claims to cover all such changes and modifications which come within the spirit and cope of the invention.

What is claimed is:

1. A height adjustable table leg comprising:

an upper tubular member;

a lower tubular member telescopingly received within the upper tubular member;

a strip attached to the lower tubular member, said strip having a series of undulations and apertures; and a handle having a cam portion at a first end pivotably supported on said upper tubular member, said cam portion having a peripheral configuration complementary to each one of said series of undulations of said strip to selectively engage and disengage said series of undulations and said handle also having a projection at a second end for selectively engaging and disengaging said apertures wherein said lower tubular member is lockable to said upper tubular member.

2. The apparatus as claimed in claim 1 wherein:

each of said apertures is located in the center of a respective undulation.

3. The apparatus as claimed in claim 1 wherein:

said handle includes a looped finger engaging portion.

4. The apparatus as claimed in claim 1 wherein:

said strip is formed of plastic.

5. The apparatus as claimed in claim 1 wherein:

each of said series of undulations is spaced-apart approximately one inch from an adjacent undulation.

6. The apparatus as claimed in claim 1 wherein:

each of said apertures is located in the center of a respective undulation;

said handle includes a finger engaging portion; and said strip is formed of plastic.

7. The apparatus as claimed in claim 6 wherein:

each of said series of undulations is spaced-apart approximately one inch from an adjacent undulation.

* * * * *